US006189231B1

(12) United States Patent
Lancer

(10) Patent No.: US 6,189,231 B1
(45) Date of Patent: Feb. 20, 2001

(54) FOOT DRYER APPARATUS

(76) Inventor: Harold Lancer, The Penthouse 9735 Wilshire Blvd., Beverly Hills, CA (US) 90212

( * ) Notice: Under 35 U.S.C. 154(b), the term of this patent shall be extended for 0 days.

(21) Appl. No.: 09/354,298

(22) Filed: Jul. 15, 1999

(51) Int. Cl.[7] ..... F26B 19/00
(52) U.S. Cl. ..... 34/90
(58) Field of Search ..... 34/90, 103, 104, 34/106, 107, 202

(56) References Cited

U.S. PATENT DOCUMENTS

| | | | | |
|---|---|---|---|---|
| 1,413,862 | | 4/1922 | MacDonald . | |
| 1,658,489 | | 2/1928 | Lindstrom . | |
| 2,184,858 | * | 12/1939 | Goodman | 219/45 |
| 2,247,483 | | 7/1941 | Eastman | 12/1 |
| 3,378,009 | | 4/1968 | Peplin | 128/266 |
| 3,711,958 | | 1/1973 | Lepage | 34/88 |
| 3,986,643 | | 10/1976 | Chutter | 222/195 |
| 4,839,483 | | 6/1989 | Doyle | 200/302.1 |
| 4,878,602 | | 11/1989 | Weigelt | 222/161 |
| 5,003,705 | | 4/1991 | Lee | 34/54 |
| 5,007,182 | | 4/1991 | Fishman et al. | 34/90 |
| 5,130,551 | | 7/1992 | Nafziger et al. | 250/492.1 |
| 5,157,850 | | 10/1992 | Terng-Shuh | 34/202 |
| 5,165,181 | | 11/1992 | Acosta, Sr. et al. | 34/90 |
| 5,438,764 | | 8/1995 | Reppas et al. | 34/343 |
| 5,617,646 | * | 4/1997 | Viscuso | 34/60 |
| 5,819,431 | | 10/1998 | Lancer | 34/90 |

* cited by examiner

*Primary Examiner*—Corrine McDermott
*Assistant Examiner*—Malik N. Drake
(74) *Attorney, Agent, or Firm*—Lyon & Lyon LLP

(57) ABSTRACT

A foot dryer includes a dryer housing having front and rear units defining a foot receiving cavity. A footrest is disposed in the foot receiving cavity for supporting a foot of a user. A blower is disposed adjacent the footrest and contained within the rear unit. The blower delivers air under pressure into the cavity. A holder supported by the housing above the user's foot may be used to dispense a moisture or fungus inhibiting agent downwardly onto the foot without the aid of the blower.

32 Claims, 4 Drawing Sheets

FOOT DRYER APPARATUS

BACKGROUND OF THE INVENTION

The present invention relates to an improved foot dryer for preventing the formation of foot fungus.

There have been many types and kinds of apparatus used to evaporate residual moisture from the feet of users and to facilitate the prevention of foot fungus. For example, see the following U.S. Pat. Nos. 1,413,862; 1,658,489; 2,247,483; 3,711,958; 3,986,643; 4,878,602; 5,003,705; 5,007,182; 5,130,551; 5,157,850; and 5,438,764.

As disclosed in the mentioned patents, various foot dryers designs show that heated air may be blown under pressure onto the foot of a user and a fungus inhibiting agent may be dispersed to help prevent the formation of foot fungus, such as athlete's foot.

While such devices may have been satisfactory for some applications, having a new and improved foot dryer which dries one's foot safely and effectively and then dispenses a desired amount of fungus inhibiting agent efficiently and conveniently is highly desirable.

U.S. Pat. No. 5,438,746 describes one attempt to dispense a desired amount of fungus inhibiting agent. In particular, a foot dryer is described having a raised housing with a perforated top plate for receiving the foot of the user. A series of conduits within the housing is in fluid communication with a blower/heater and powder dispensing unit that dry and dispense respectively. More particularly, the device dispenses a metered amount of powder into one of the conduits. Air under pressure then carries the powder onto the bottom of the toes and foot via the perforation in the top plate.

Though such a device could dry the user's foot and dispense a fungus inhibiting agent, such a device could not be readily and effectively used repeatedly as the dispensed powder could easily and readily accumulate in the apertures of the top plate of the foot dryer. Also, the dispensed powder would be blown into the air causing the surrounding areas around the dryer to be coated with the dispensed powder. Thus, not only would the apertures become easily blocked after repeated use of the dryer, but use of the device would also result in unnecessary and unwanted clean up activities after each use. Moreover, if one used the device straight from a shower or bath, excess fluids would accumulate in the apertures and form an undesirable paste with the powder that may inhibit effective use of the device and promote unwanted clean up.

Therefore, having a new and improved foot dryer that dries feet safely and effectively and can dispense a fungus inhibiting agent without causing unnecessary and undesired cleaning maintenance is highly desirable. Moreover, such a new and improved drying device should be able to be used repeatedly over long periods without contaminating the areas around the device with dispensed powder.

SUMMARY OF THE INVENTION

Therefore, the principal object of the present invention is to provide a new and improved foot dryer to dispense a fungus inhibiting agent in a safe and effective manner.

Another object of the present invention is to provide such a new and improved foot dryer that may distribute heated air under pressure over the entire upper and lower portions of the foot of the user safely and effectively.

Briefly, the above and further objects of the present invention are realized by providing a foot dryer having a dryer housing comprised of a front unit and a rear unit that defines a foot receiving cavity with the dryer housing. A blower mounts within the dryer housing for delivering air under pressure onto the top and bottom portions of the foot of the user in a safe and effective manner.

A container or mist dispenser for dispensing a powder downwardly onto one's toes is supported by the rear unit of the dryer housing. The dispenser may include an agitator and control mechanism for selectively dispensing an amount of moisture inhibiting or fungus inhibiting powder directly onto the foot of the user.

BRIEF DESCRIPTION OF THE DRAWINGS

The above-mentioned and other objects and features of this invention and the manner of attaining them will become apparent, and reference to the following description will best explain the preferred embodiments, taken in conjunction with the accompanying drawings, wherein.

DETAILED DESCRIPTION OF THE PREFERRED EMBODIMENTS

Figure 1:
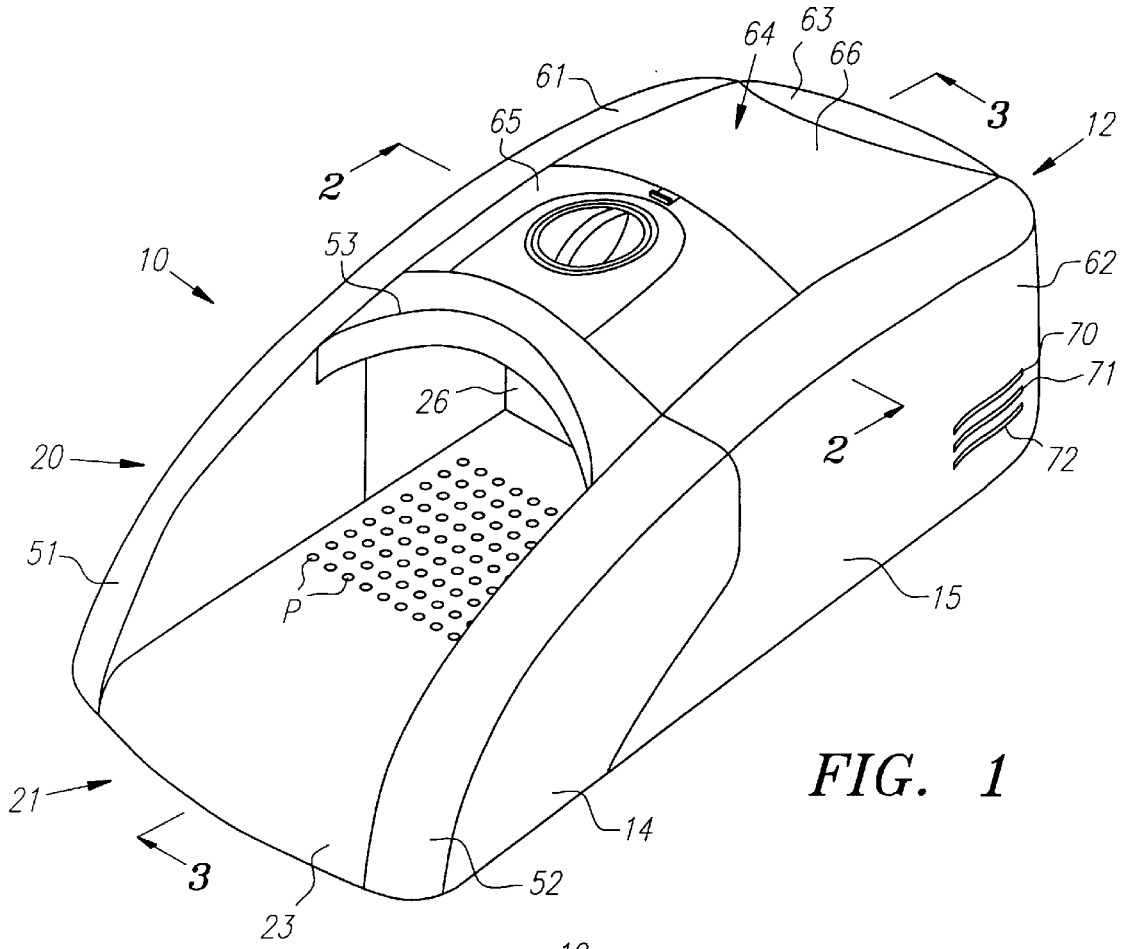
FIG. 1 is a pictorial view of a foot dryer according to a preferred embodiment.

FIGS. 1–5 illustrate a foot dryer 10 according to a preferred embodiment. The foot dryer 10 is adapted to distribute warm air over the foot 16 or feet of a user for drying purposes. Moreover, in order to help prevent the formation of foot fungus, the foot dryer may bathe the user's feet with a fine mist of a moisture inhibiting or fungus inhibiting powder or agent 11.

The dryer 10 comprises a dryer housing 12 having a base plate 13 for supporting a front unit 14 and a rear unit 15. The front and rear units 14 and 15 may be removably secured together to facilitate cleaning and repair. The front and rear units 14 and 15 define a foot receiving cavity or space 20 having an entrance way 21. A partition or stop 26 may be disposed within the cavity 20 for helping one to position his or her toes properly within the cavity 20. The foot receiving cavity 20 may be adapted to receive one foot or both feet of the user. The cavity 20 shown in FIG. 3 is sufficiently large to receive both feet of the user.

Figure 2:
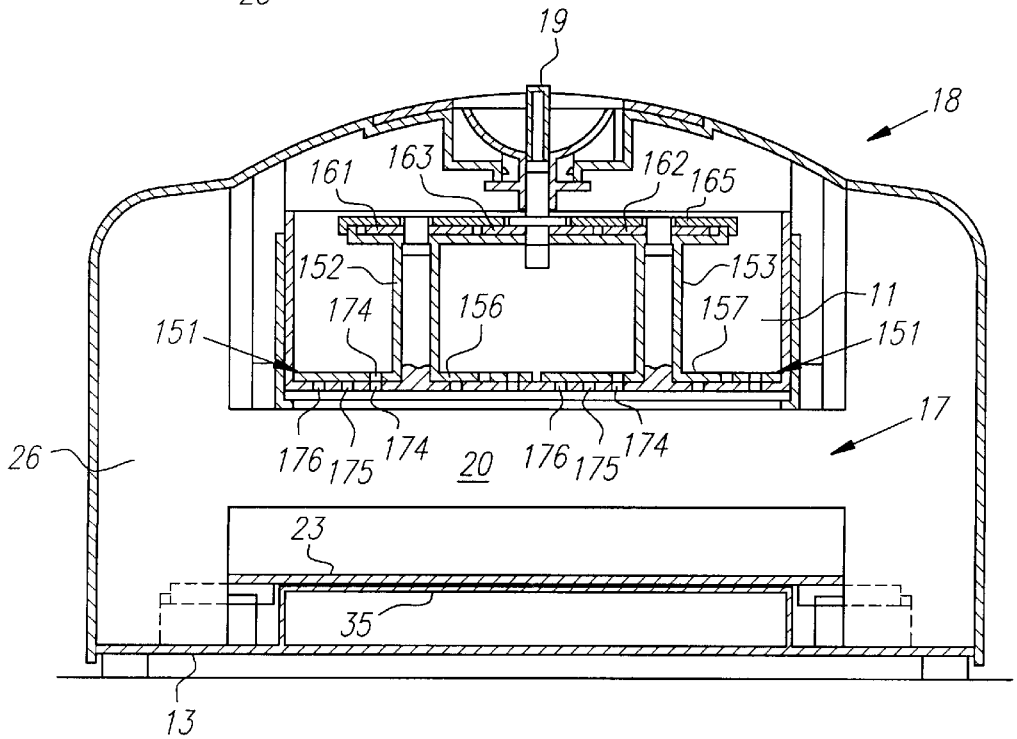
FIG. 2 is a slightly enlarged sectional view of the foot dryer of FIG. 1, taken substantially on line 2—2 thereof.

In order to bathe the user's feet with a flow of warm or heated air under pressure, the dryer 10 may include a blower 30 and a heater 40. The blower 30 and heater 40 may be disposed above the base plate 13 within the rear unit 15. As best seen in FIG. 2, the blower 30 and the heater 40 are in fluid communication with one another and in fluid communication with the cavity 20. A thermostat (not shown) may optionally be coupled to the heater 40 for controlling the temperature of the air under pressure. In this manner, the user can adjust the thermostat to cause the temperature of the air delivered under pressure to the cavity 20 to change between an off or ambient room temperature and a fully on or maximum temperature depending on the amount of moisture to be evaporated from the user's feet.

An electrical cord with an electrical socket male plug (not shown) plugs into a source of electrical power for supplying the blower 30 and the heater 40 with electrical energy. The electric cord may be connected to a rechargeable battery pack (not shown) housed within the dryer 10. When not in use, the electric cord may recharge the battery pack allowing the dryer 10 to have all the advantages of a portable, battery-powered device.

Figure 3:
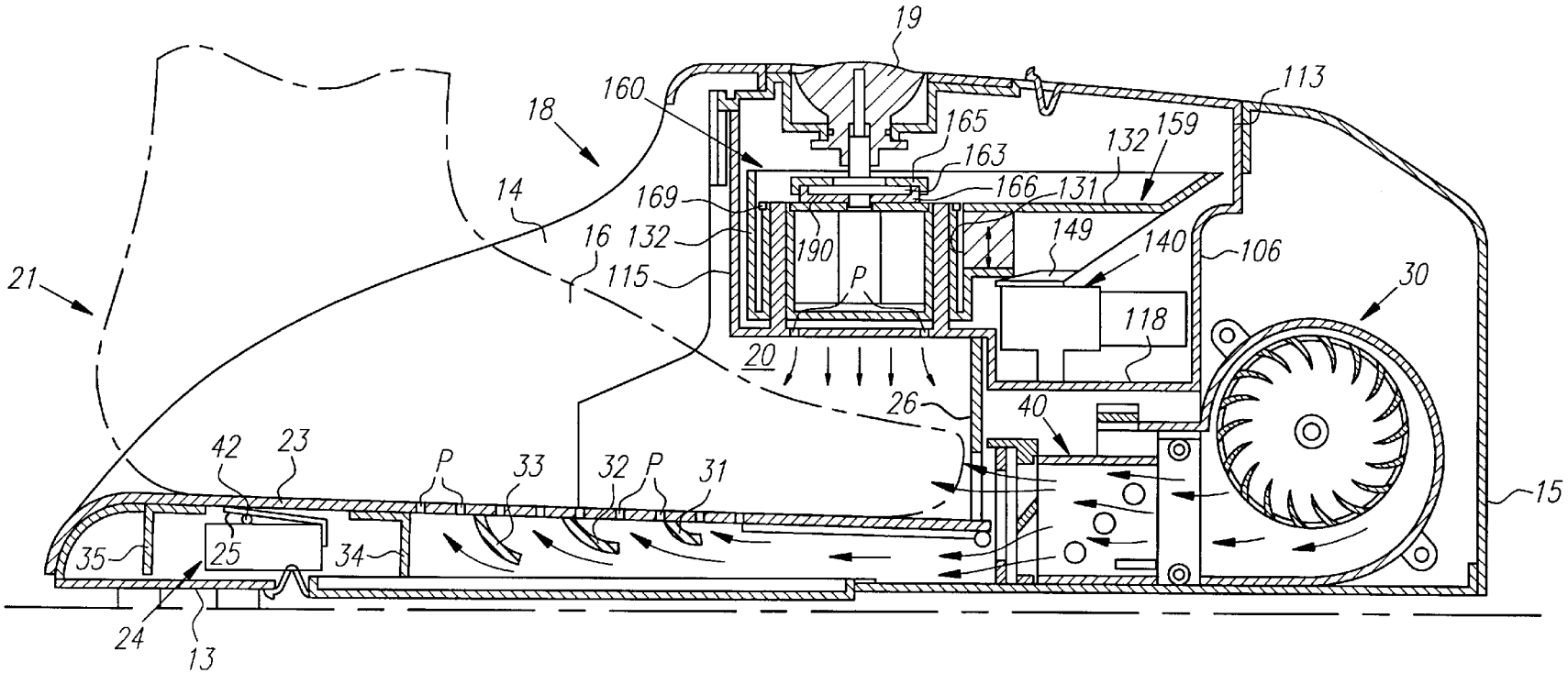
FIG. 3 is a slightly enlarged sectional view of the foot dryer of FIG. 1, taken substantially on line 3—3 thereof.

The dryer 10 includes a holder or container, such as holder 18 shown in FIG. 3. Holder 18 is disposed above the user's foot for distributing a powder thereon. As shown in FIG. 3, holder 18 is supported within the rear unit 15 above the base plate 13 and the blower 30. In particular, the holder 18 is preferably disposed above an elongated footrest or frame member 23 supported by the base plate 13. Blower 30 is disposed adjacent one end of the frame member 23. The footrest allows a user to rest his or feet within the cavity 20 beneath the holder 18. Such a configuration advantageously allows a user to distribute powder directly onto the user's foot without the aid of the blower 30. By using gravity instead of forced air, the preferred embodiments disclosed herein allow for controlled powder dispensing. The powder which is dispensed is preferably a moisture inhibiting or fungus that inhibits the growth of foot fungus, such as athlete's foot.

Holder or mist dispenser 18 may include a rate control knob 19 for selectively bathing the foot of the user with a fine mist of airborne particles 17 of the moisture or fungi inhibiting agent 11. After the user has dried his or her feet in the dryer 10, the user may select, via the control knob 19 a desired amount of the mist particles 17 to be dispensed from the dispenser 18. The dispenser 18 may be adapted to dispense the agent 11 within the cavity 20 in a short period of time between about one second and about one minute depending upon the amount of agent 11 the user desires to have his or her feet bathed with for moisture or fungus inhibiting purposes.

As illustrated in FIG. 3, footrest 23 may be an elongated switch plate 23 disposed above the base plate 13 for supporting the user's foot. Plate 23 may include small perforations or apertures such as perforations P. Perforations P are preferably sufficiently large to allow air under pressure to flow upward through them, but small enough to help prevent moisture flowing down through them. Thus, any residual moisture that flows from the feet into a perforation P may be substantially held within the perforation P due to its small size. The air under pressure may then quickly evaporate the moisture.

Switch plate 23 may be adapted to allow the user to activate and deactivate the dryer 10 easily during use. As shown in FIG. 3, the enlarged perforated switch plate 23 may be rockably mounted within the dryer housing 12 between the front and rear units 14 and 15. A waterproof micro-switch 24 having a depending spring member 25 may be mounted between the switch plate 23 and a lower portion of a bottom air baffle unit 27 that is supported by the base plate 13.

When a sufficient amount of force is applied downwardly on the switch plate 23, the switch plate 23 moves pivotally downwardly to cause the spring member 25 to become fully compressed in engagement with an actuator 42 forming part of the micro-switch 24. The complete compression of the spring member 25 permits the micro-switch 24 to be actuated, which in turn establishes an electrical signal path between the source of electrical power (via the electrical cord or rechargeable battery pack) and the blower 30 and the heater 40. The blower 30 and the heater 40 may respond to the electrical power signal to supply the cavity 20 with air under pressure to facilitate the drying of the user's feet in a fast and efficient manner.

The lower air baffle unit 27 may be in fluid communication with the blower 30 and heater 40. The lower air baffle unit 27 may include a curved ribbed frame member 28, which may have a plurality of evenly spaced apart louvers or ribs 31–33. The louvers 31–33 may be of different widths and sizes, and cooperate with the frame 28 and a back rib 34 to cause air passing into the frame member 28 to be evenly distributed into the cavity 20 as it is blown against the perforated switch plate 23. Air under pressure may then flow uniformly into contact and across the bottom portion of the feet and toes of the user when the user is depressing the switch plate 23 downwardly with a sufficient force to activate the switch 24.

In operation, the user places one or both of his or her feet into the cavity space 20 of the dryer 10 a sufficient distance to allow the toes of the user to engage the partition 26. The user then moves his or her foot backward to slightly space the toes from the partition bringing the bottom of the foot into engagement with the switch plate 23.

The user then presses the heel of his or her foot or feet downwardly against the switch plate 23 with a sufficient amount of force to cause the switch plate 23 to move rockably downwardly to activate the micro-switch 24. When the micro-switch 24 is activated, the blower 30 supplies the cavity space 20 with a uniform flow of air under pressure via the upper and lower air baffle units 14 and 27, respectively.

If the user desires the drying process to be expedited, the user may increase the temperature of the air under pressure by adjusting the thermostat to a desired temperature. When the foot or feet of the user are dry, the user removes his or her foot or feet from the cavity space 20, which in turn causes the micro-switch 24 to move to its normally open position thereby removing the electrical signal from the blower 30 and the heater 40.

In another embodiment of the present invention, the thermostat 40 may be a smart thermostat that automatically controls the temperature of the air under pressure. In this regard, ambient temperature air is delivered to the cavity during a first period of time. During a second period of time the temperature of the air under pressure is increased from the ambient temperature level to a maximum temperature level. Finally, during a third period of time, the temperature of the air under pressure is decreased from the maximum temperature level to the ambient temperature level. In this controlled manner, the temperature of the air under pressure may not be maintained at a sufficiently high level to cause the feet and toes or the user to be overly heated. Thus, the feet do not sweat which in turn allows the feet to remain dry for preventing the growth of fungi.

In still yet another embodiment of the present invention, the activation of the micro-switch 24 may cause the dispenser 18 to create a fine mist of moisture inhibiting particles 17 after the drying cycle of the dryer has been completed. Such particles 17 remain in the dispenser 18 until the user activates the control knob 19 after the drying cycle has been completed. In this regard, at the end of the above-disclosed drying process, the user removes the pressure from the switch plate 23 causing the blower 30 and the heater 40 to be deactivated. At about the same time or simultaneously, the user rotates the control knob 19 to a desired dispensing rate allowing the particles 17 to enter into the cavity space 20. The dispenser 18 operates for a sufficient amount of time of between about 0.5 seconds and about 5 seconds to permit bathing of the foot or feet of the user.

In the event the user desires an additional amount of bathing to take place after the dispenser 18 has ceased operation, the user may press and release the control knob 19 which in turn will cause the dispenser to manually produce an additional amount of mist particles 17. This manual procedure may be repeated as often as desired to allow the appropriate amount of particle bathing to be accomplished in accordance with the desires of the user. Thus, the foot or feet of the user are advantageously dried in a fast and efficient manner for prompting healthy feet and if so desired the foot or feet of the user are further bathed with fine mist particles 17 of fungi inhibiting or moisture inhibiting agents to further promote healthy, fungi-free feet.

As the particles 17 are dispensed within the cavity 20 at about the rear containment unit 15, the particles 17 remain in the cavity 20 and do not leave the dryer 10. Thus, the area surrounding the dryer 10 is not coated with the powder before, during or after the dispensing cycle.

Considering now the construction of the dryer 10 in greater detail with reference to FIGS. 1–5, the mist dispenser 18 may include an outer powder pan or box 102 having a pair of side wall members 104 and 106, each with a set of integrally connected hollow support legs, such as support legs 108 and 109. The support legs on the side wall members 104 and 106 may be slidably received and supported on a corresponding set of upright support post members (not shown) that are integrally connected to and extend perpendicularly upward from the base plate 13.

As best seen in FIG. 3, the outer powder pan 102 may also include a pair of end wall members 113 and 115, respectively. The end wall members 113 and 115 may be integrally connected to the side wall members 104 and 106 to form a generally rectangularly shaped open box-like configuration with a stair-step shaped base or bottom member 116.

The integrally connected base member 116 may include an upper or forward floor member 117 and a lower or rear floor portion 118. The upper member 117 may be rectangularly shaped and include a pair of centrally disposed generally overlapping circular shaped cutouts 121 and 122 that face the footrest 23 to help facilitate the dispensing of the inhibiting agent 11 into the cavity 20. In this regard, the cutouts 121 and 122 may provide a direct passageway P from the dispenser 18 into the cavity 20.

The lower portion 118 may be generally rectangularly shaped and support a vibrator 140. The vibrator 140 is preferably coupled by a cam member 149 to a pair of agitator members 150 and 151 that respond to the vibrator 140 by moving rapidly up and down in a rectilinear path of travel in the inhibiting agent 11. As the agitators 150 and 151 move up and down in the inhibiting agent 11, particles 17 may fall under the force of gravity into the cavity 20.

The mist dispenser 18 may also include an inner powder pan or box 130 for holding a reservoir of the inhibiting agent 11. The inner powder box 130 may be configured to be received within the outer powder box 102. The inner powder box 130 may have a pair of side wall members 134 and 136 that are integrally connected together at one of the terminal ends by a generally rectangularly shaped end wall member 132.

A base or floor member 138 may be integrally connected between the bottom lips of the end wall member 132 and the sidewall members 134 and 136, respectively, to form an open container for receiving the inhibiting agent 11. The other terminal ends of the side wall members 134 and 136 may be integrally connected to another end wall member 133 that flares outwardly and upwardly at an angle from the base 138. The other terminal ends of the side wall members 134 and 136 are preferably triangularly shaped and extend upwardly and away from the floor 130 to joining the end wall 133.

Figure 4:
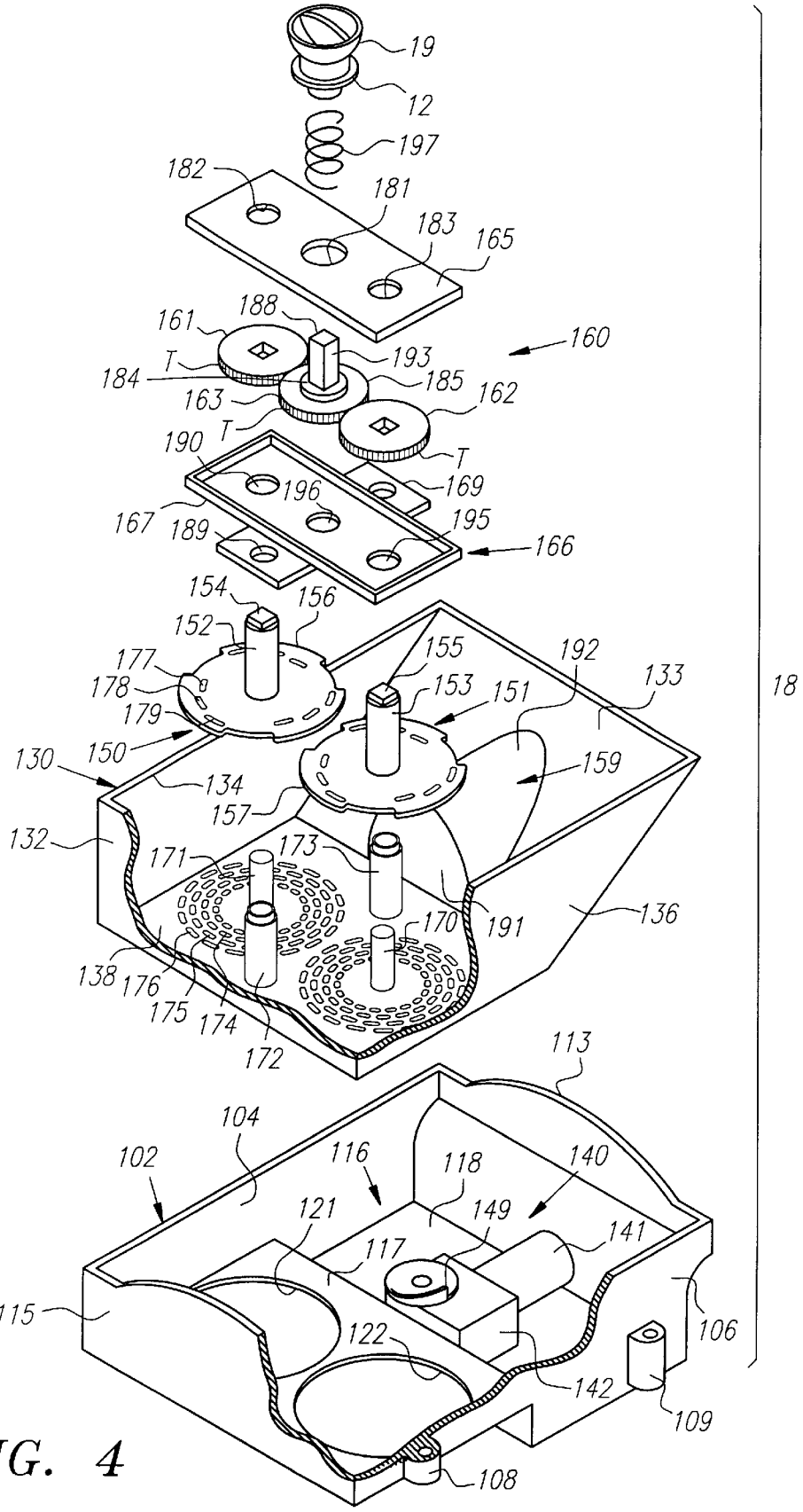
FIG. 4 is a greatly enlarged exploded view of a mist dispenser forming part of the foot dryer of FIG. 1.

As FIG. 4 shows, the end wall member 133 may have a centrally disposed hollow boss 159 having a smooth flat front face 191 and a smooth rounded top 192. The boss 159 may be sufficiently large to receive a portion of the vibrator 140 when the inner powder box 130 is received within the outer powder box 102.

Floor member 138 may include a pair of spaced apart upright agitator support members 170 and 171. Each support member may be surrounded by a set of cutouts or slits, such as slits 174–176. Each of the agitators 150 and 151 may include hollow spools or spindles 152 and 153, respectively, that may be slidably received on the respective support member 170 and 171 to facilitate up and down movement in the inner powder box 130.

The agitators 150 and 151 may include powder discs 156 and 157 at their respective distal ends. Each powder disc may include a corresponding sets of slots, such as slots 177–179. The rotation of the agitators 150 and 151 permit one set of corresponding slits and slots, such as slit 174 and slot 177, to be aligned to facilitate dispensing the inhibiting agent 11 at a given rate that is adjustable between a nominal flow rate when there is no alignment between slits and slots and a maximum flow rate when the largest slits and slots are aligned, such as slit 176 and slot 179.

Holder or mist dispenser 18 may include a gear box 160 that is coupled between the control knob 19 and the agitators 150 and 151, respectively. The gear box 160 may be supported by a pair of spaced-apart gear box support members 172 and 173 that extend perpendicularly upwardly from the inner powder box floor 138. The gear box 160 may include a right gear member 161 and a left gear member 162 which are received onto end portions 154 and 155 of the agitators spindles 152 and 153, respectively. The gear members 161 and 162 may be spaced apart and interconnected to one another by a central gear member 163, which is in turn coupled to the control knob 19 by a center gear spindle 193.

As the user rotates the control knob 19, the central gear member 163 rotates the respective right and left gear members 161 and 162. As gear members 161 and 162 rotate, agitators 150 and 151 rotate about their respective support posts 170 and 171. The rotation of agitators 150 and 151 allows their associated slots to be positioned relative to the respective slits disposed within the floor member 138, such as slits 174–176, for aiding a user to dispense a fine mist of powder over the user's feet. Considering now the gear box 160 in greater detail with reference to FIGS. 2 and 4, the gear box 160 may generally include an upper gear cabinet member 165 and a lower cabinet member 166 spaced apart from one another by a central gear member 163. The central gear member 163 and the right and left gear members 161 and 162 are respectively disposed in the gear box 160 between the upper cabinet and the lower cabinet members 165 and 166.

The lower cabinet member 166 may include an upright outer wall member 167 for receiving gears 161–163. The upper cabinet member 165 may be disposed on the outer wall member 167 to form an enclosed space 190 with the gear box 160.

The gear box 160 may also include a lower support plate 169 for supporting the low gear cabinet 166 relative to the inner powder box 130 via post members 172 and 173. Plate 169 may include a pair of holes, such as hole 189, for receiving the inner powder box posts, such as post 172.

In order to facilitate the free rotational movement of the gears 161–163 relative to the agitators 150 and 151, the upper cabinet member 165 may include a set of spaced apart spindle holes 182 and 183, respectively. Spindle holes 182 and 183 are preferably configured to respectively receive the agitator spindles 152 and 153 so that the spindles rotate with little or no friction.

A central gear hole 181 may be disposed between the spindle holes 182 and 183 for receiving the central gear member 163 with relatively friction free rotational and up and down movement. The central gear member 163 may include upper and lower circular stops 184. A circular gear 185 may be disposed between the stops 184. The circular gear 185 preferably includes an outer set of teeth (T) that intermesh with like sets of teeth (T) on the right and left gears 161 and 162.

As shown in FIG. 4, hollow post or spool member 193 may be centrally disposed and integrally connected to the stops 184, as. well as with the gear 185. The spool member 193 may be generally box shaped having an open terminal end 188 for frictionally engaging a corresponding central post 124 forming part of the central knob 19.

To further facilitate free rotational movement of gears 161–163 relative to agitators 150 and 151, lower cabinet member 166 may include another set of spaced apart spindle holes 190 and 195, respectively. Spindle holes 190 and 195 are adapted to respectively receive agitator spindles 152 and 153 with relatively friction free rotational movement.

Another central gear hole 181 may be disposed between the spindle holes 190 and 195 and may be dimensioned for receiving the central gear member 163 for relatively friction free rotational and up and down movement. A control knob spring 197 mounts around the control knob post 124 and is held in a fixed position between a control knob flange 125 and the upper stop 184 of the central gear member 163.

As shown in FIGS. 2 and 3, vibrator 140 may include a vibrator motor 141 and a vibrator gear housing 142. The motor 141 may be mounted to the floor of the outer powder box 102 and coupled to the cam member 149 for rotation about its longitudinal axis. As the cam rotates about its axis with a sufficient amount of force to cause inner powder box 130 to move up and down, agitators 150 and 151 move up and down in a rectilinear path of travel through the powder agent 11.

FIGS. 1 and 2 show the front unit 14 in great detail. Front unit 14 may include a molded plastic construction having a right leg member 51 and a left leg member 52 which interconnect at one of their respective ends through an intermediate member 53.

The rear unit 15, which FIGS. 1 and 3 show in detail, may include a right side wall member 61, a left side wall member 62, a rear wall member 63 and a top 64, having a front portion 65, a rear removable cover 66. The rear unit 15 may include a molded plastic construction except for the removable cover 67.

Referring to the right and left side wall members 61, 62 in greater detail, each side wall member (such as side wall member 62) may have a set of spaced apart air vents 70–72 that permit atmospheric ambient air to be drawn into the blower 30 for distribution to the cavity 20. The side wall members 61 and 62 may be integrally connected at the rear periphery to the rear wall 63 to form an aesthetically pleasing, smooth rounded edge joint. The base or bottom edge of the rear air baffle unit 27 may be configured to interlock with the base plate 13 to form a substantially air tight seal. The interlock allows one to remove the air baffle unit 27 from the base plate 13.

Figure 5:
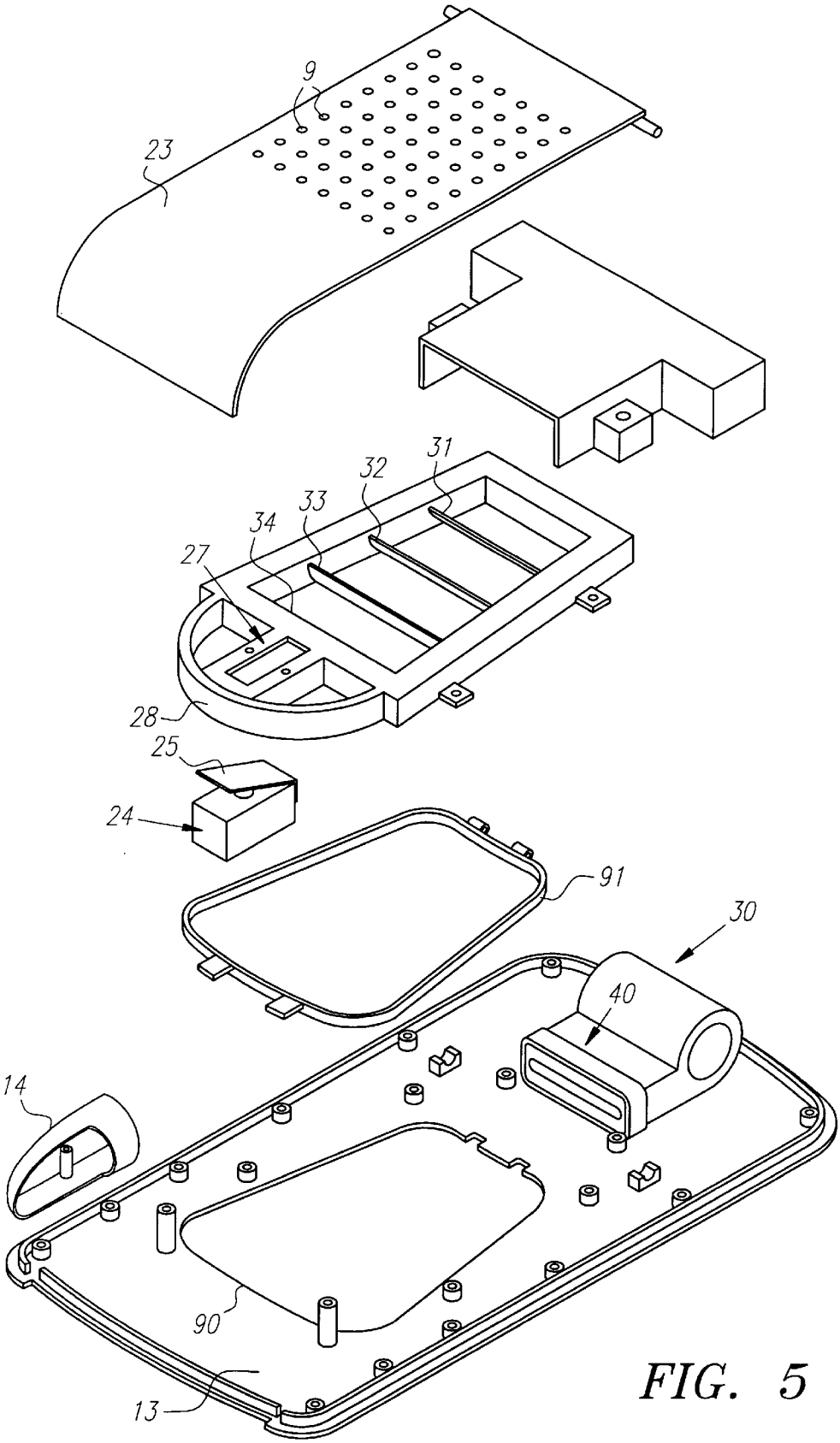
FIG. 5 is an exploded pictorial view of a supporting base forming part of the foot dryer of FIG. 1.

Turning in detail to FIG. 5, the base plate 13 may include a centrally disposed hole 90. Hole 90 is adapted to receive a cleaning tray 91. When seated in hole 90, tray 91 is disposed below the switch plate 23 for advantageously collecting and holding any residual powder particles, e.g., particles 17, that may fall from one's feet through the perforations P. Once full, a user lifts or rotates plate 23 in order to remove tray 91 and empty it of its contents.

While preferred embodiments are disclosed herein, many variations are possible which remain within the concept and scope of the invention. Such variations would become clear to one of ordinary skill in the art after inspection of the specification and drawings herein. The invention therefore is not to be restricted except within the spirit and scope of any appended claims.

What is claimed is:

1. A drying apparatus comprising:

a frame member for supporting an object to be dried thereon;

a blower disposed adjacent one end of the frame member; and a holder disposed above the frame member for dispensing powder onto the object to be dried.

2. A drying apparatus according to claim 1 further comprising a heater disposed adjacent the blower.

3. A drying apparatus according to claim 1 wherein the frame member includes perforations.

4. A drying apparatus according to claim 1 wherein the holder is disposed above the blower.

5. A drying apparatus according to claim 1 wherein the holder comprises an outer pan and an inner powder box.

6. A foot dryer comprising:

an elongated footrest;

a blower disposed adjacent the footrest; and a powder container disposed above the footrest, wherein the container has an opening which faces the footrest for dispensing powder from the opening onto the footrest.

7. A foot dryer according to claim 6 further comprising an agitator disposed within the powder container.

8. A foot dryer according to claim 6 further comprising a control mechanism for selectively dispensing powder from the powder container.

9. A foot dryer according to claim 6 further comprising a vibrator that aids in dispensing powder from the powder container.

10. A foot dryer according to claim 6 where in the powder container comprises an outer pan and an inner powder box.

11. A drying apparatus comprising:

a housing having a front and a rear;

a foot support member disposed about the front;

a blower disposed about the rear; and a powder holder disposed above the foot support member for dispensing powder onto a foot resting on the foot support member without the aid of the blower.

12. A drying apparatus according to claim 11 wherein the powder holder is disposed above the blower.

13. A drying apparatus according to claim 11 further comprising an agitator supported by the powder holder.

14. A drying apparatus according to claim 13 wherein the powder container comprises an outer pan and an inner powder box.

15. A drying apparatus according to claim 11 further comprising a heater disposed between the foot support member and the blower.

16. A foot dryer comprising:

a footrest;

a housing having an open drying chamber disposed about the footrest;

a blower contained within the housing; and a holder for dispensing powder onto the footrest.

17. A foot dryer according to claim 16 wherein the holder is disposed above the footrest.

18. A foot dryer according to claim 17 wherein the holder is disposed above the blower.

19. A foot dryer according to claim 16 further comprising an agitator disposed within the holder.

20. A foot dryer according to claim 16 further comprising a control mechanism for selectively dispensing powder from the holder.

21. A foot dryer according to claim 16 further comprising a vibrator that aids in dispensing powder from the holder.

22. A drying apparatus comprising:

a footrest;

a powder container adapted to dispense powder onto the footrest; and a removable tray for collecting powder dispensed by the powder container.

23. A drying apparatus according to claim 22 further comprising a blower disposed adjacent the footrest.

24. A drying apparatus according to claim 23 further comprising a heater disposed adjacent the blower.

25. A drying apparatus according to claim 22 further comprising an agitator supported by the powder container.

26. A drying apparatus according to claim 22 wherein the powder container comprises an outer pan and an inner powder box, and wherein the outer pan includes an opening which faces the footrest for dispensing powder thereon.

27. A drying apparatus according to claim 26 further comprising a control mechanism for selectively dispensing powder from the powder container.

28. A drying apparatus comprising:

a frame member for supporting an object to be dried thereon;

a blower disposed adjacent one end of the frame member; and a holder disposed above the frame member for dispensing powder onto the object to be dried, wherein the holder comprises an outer pan and an inner powder box.

29. A foot dryer comprising:

an elongated footrest;

a blower disposed adjacent the footrest;

a powder container disposed above the footrest, wherein the container has an opening which faces the footrest for dispensing powder from the opening onto the footrest; and a vibrator that aids in dispensing powder from the powder container.

30. A drying apparatus comprising:

a housing having a front and a rear;

a foot support member disposed about the front;

a blower disposed about the rear; and a powder holder disposed above the foot support member for dispensing powder onto a foot resting on the foot support member without the aid of the blower, wherein the powder holder comprises an outer pan and an inner powder box.

31. A foot dryer comprising:

a footrest;

a housing having an open drying chamber disposed about the footrest;

a blower contained within the housing;

a holder for dispensing powder onto the footrest; and a vibrator that aids in dispensing powder from the holder.

32. A drying apparatus comprising:

a footrest;

a powder container adapted to dispense powder onto the footrest, wherein the powder container comprises an outer pan and an inner powder box; and a removable tray for collecting powder dispensed by the powder container.

* * * * *